US008388321B2

(12) United States Patent
Wilmsen

(10) Patent No.: US 8,388,321 B2
(45) Date of Patent: Mar. 5, 2013

(54) POSITIVE DISPLACEMENT PUMP APPARATUS

(75) Inventor: Arnoldus Gertrudis Hendrikus Wilmsen, Reuver (NL)

(73) Assignee: Weir Minerals Netherlands B.V., Venlo (NL)

( * ) Notice: Subject to any disclaimer, the term of this patent is extended or adjusted under 35 U.S.C. 154(b) by 561 days.

(21) Appl. No.: 12/521,259

(22) PCT Filed: Jan. 9, 2008

(86) PCT No.: PCT/NL2008/000009

§ 371 (c)(1),
(2), (4) Date: Aug. 4, 2009

(87) PCT Pub. No.: WO2008/085031

PCT Pub. Date: Jul. 17, 2008

(65) Prior Publication Data

US 2010/0014996 A1 Jan. 21, 2010

(30) Foreign Application Priority Data

Jan. 10, 2007 (NL) ..... 1033204

(51) Int. Cl.
*F04B 9/08* (2006.01)
*F01B 19/02* (2006.01)
*F16D 31/02* (2006.01)

(52) U.S. Cl. ..... 417/383; 92/96; 60/413

(58) Field of Classification Search ..... 417/383, 417/413.1, 415; 92/96; 60/413, 415, 417
See application file for complete search history.

(56) References Cited

U.S. PATENT DOCUMENTS

| | | | | |
|---|---|---|---|---|
| 2,287,627 | A | 6/1942 | Malsbary et al. | |
| 3,527,550 | A | 9/1970 | Flynn et al. | |
| 5,593,288 | A | 1/1997 | Kikutani | |
| 6,796,215 | B1 * | 9/2004 | Hauser et al. | 92/80 |
| 7,201,097 | B2 * | 4/2007 | De Koning | 92/92 |
| 2004/0006980 | A1 * | 1/2004 | Berthod et al. | 60/413 |
| 2006/0110268 | A1 | 5/2006 | De Koning | |
| 2007/0128056 | A1 * | 6/2007 | Haudenschild | 417/415 |

FOREIGN PATENT DOCUMENTS

| | | | |
|---|---|---|---|
| CH | 251213 | A | 10/1947 |
| DE | 3338112 | A1 | 5/1985 |
| DE | 8521520 | U1 | 4/1987 |
| EP | 408127 | A2 * | 1/1991 |
| EP | 0408127 | A2 | 1/1991 |
| FR | 2531147 | A | 2/1984 |

* cited by examiner

*Primary Examiner* — Charles Freay
(74) *Attorney, Agent, or Firm* — Muncy, Geissler, Olds & Lowe, PLLC

(57) ABSTRACT

A positive displacement pump apparatus includes a pump chamber in a pipe system for receiving a pumping fluid, the pipe system having an inlet and an outlet which can be shut by a valve. The chamber is connected via an intermediate fluid chamber with a displacement element including a piston head and a piston rod, which is arranged to alternately carry out a suction stroke and a displacement stroke during its movement to displace fluid in the intermediate fluid chamber, thereby increasing or reducing the volume of the pump chamber. A flexible separating element including a diaphragm is provided at the pump chamber to separate the fluid in the intermediate fluid chamber from the pumping fluid. A force member is provided for applying force to the piston head during the displacement stroke to counteract force exerted on the piston head by the fluid in the intermediate fluid chamber.

19 Claims, 11 Drawing Sheets

(state of the art)

POSITIVE DISPLACEMENT PUMP APPARATUS

TECHNICAL FIELD

A positive displacement pump apparatus is disclosed for the pumping of media such as liquids or gases. Also disclosed herein is a method of controlling the operation of a positive displacement pump. It should be appreciated that the method and apparatus can be applied to many different designs of positive displacement pump including multiple chamber pumps.

BACKGROUND ART

Positive displacement pumps are widely used. Such pumps can comprise one or more pump chambers, each chamber having an inlet and an outlet. In use, the inlet and outlet can be sequentially opened and closed. In the known apparatus each pump chamber may be arranged with at least one displacement element, which can be moved by some sort of driving means arranged adjacent to the pump chamber. During its movement, the displacement element alternately carries out a suction stroke and a displacement stroke thereby increasing and reducing, respectively, the volume of the pump chamber.

In some prior art embodiments the pump chamber can have at least one flexible separating element which forms at least part of the side wall thereof and which functions to separate the displacement element from the fluid which is being pumped through the chamber.

Such displacement pumps are generally used in pump and/or compressor systems for pumping or displacing aggressive and/or abrasive media such as particulate slurries, or some corrosive liquids or gases which may be at high temperature or under high pressure. In one embodiment of a known displacement device, a certain amount of medium to be displaced is carried into the pump chamber via the inlet side (and from the pipe system) during the suction stroke of the displacement element, and this same amount of medium is displaced (or forced) out of the pump chamber via the outlet side during the displacement stroke of the displacement element.

The driving means, which impose a translating movement on the displacement element, may be a linear motor, a magnet drive, a hydraulic drive, a camshaft drive, an eccentric drive, a crank-connecting rod mechanism, etc. In normal operational circumstances, the displacement element undergoes a displacement stroke loaded by the working pressure and a non- or low-loaded suction stroke. As a result of this unbalanced application of forces, the constructional dimensions of the displacement element and its respective parts are geared to the loaded displacement stroke.

The object of the invention is to provide a displacement pump apparatus in which the load on the moving parts is significantly reduced.

SUMMARY OF THE INVENTION

The present invention provides a positive displacement pump apparatus for displacing a pumping fluid, the apparatus comprising:

one or more pump chambers arranged in a pipe system for receiving the pumping fluid, the pipe system having at least one inlet which can be shut off by means of a valve, and at least one outlet which can be shut off by means of a valve;

wherein the one or more pump chambers are connected via at least one intermediate fluid chamber with at least one displacement element, the displacement element being arranged to alternately carry out a suction stroke and a displacement stroke during its movement so as to displace fluid in the intermediate fluid chamber, which thereby increases and reduces, respectively, the volume of the pump chamber;

and wherein at least one flexible separating element is provided at the pump chamber to separate the fluid in the intermediate fluid chamber from the pumping fluid, wherein according to the invention a force means is provided for applying force or energy to a side of said at least one displacement element at least during the displacement stroke, in such a manner that said force or energy counteracts the force exerted on the displacement element by the fluid in the intermediate fluid chamber, thereby reducing the overall force needed to carry out the displacement stroke movement of the displacement element.

In one embodiment, the displacement element can be moved by a driving means arranged at one side of the pump chamber.

In one embodiment, the force means can receive force or energy which is generated during the suction stroke.

As a result of the exertion of an additional force on the displacement element, the load to which the various parts are subjected during operation of the displacement device can be greatly reduced.

Moreover, because the displacement element is not directly in contact with the pumping fluid, but separated using a separating element and an intermediate fluid chamber, the compensation forces can be applied directly on the displacement element as this displacment element is operating in a clean intermediate fluid, further limiting its constructional dimensions. By compensating the loaded displacement stroke and loading the non-loaded suction stroke with approximately the same compensation force, the total load is distributed over the entire stroke of the displacement element. The entire driving gear can be loaded with a much higher displacement energy, or a drive means having smaller dimensions can be used in the same operating conditions.

In one embodiment, the force means can be located on a side of the displacement element which is opposite to the side on which the pump chamber is located.

In one embodiment the force means can be a fluid such as an hydraulic oil or an aqueous fluid or a gas.

In an alternative embodiment, the force means can comprise at least one spring element, which engages said at least one displacement element on a side of the displacement element which is opposite to the side on which the pump chamber is located.

In a further alternative embodiment, the force means can comprise a gas-biased accumulator for a working medium, which accumulator is in communication with a side of the displacement element which is opposite to the side on which the pump chamber is located. In this way a counterpressure or an opposing force can be exerted on the displacement element in an effective manner, in particular during the displacement stroke, resulting in reduced forces or loads on the moving parts of the apparatus. In one form of this, the working medium may be a pressurisable fluid, in particular a gas. In such an embodiment the accumulator can function as a reservoir for fluid which is displaced into and out of the accumulator depending on the position of the displacement element.

In one embodiment, the side of at least one of the displacement elements which is opposite to the side on which the pump chamber is located can be in communication with a side of at least one of the other displacement elements which is also located on the opposite side of another respective pump chamber. In one form of this arrangement, a number of displacement elements can be mutually translated in phase with one another in such a manner that the volume on the sides of the displacement elements which are in communication with one another is contiguous, and that the sum of the volumes remains substantially or entirely constant.

In other words, when the force means is a fluid, whilst one displacement element is extended on a displacement stroke, another of the displacement elements is retracted on a suction stroke at that moment, so that the fluid can flow from the region behind one displacement element to the region behind the respective other displacement element. The advantage of this is that the various pump sections of the positive displacement pump support one another in a self-contained manner. This results in an effective utilisation of the pressurised working medium, so that said medium can at all times support the delivery stroke of the various pump chambers of the positive displacement pump. In one particular form of this arrangement, the said contiguous volume may be defined within a manifold.

In one embodiment, the or each displacement element can be a plunger piston.

In one embodiment, the or each flexible separating element can forms one wall or a portion of a wall of the intermediate chamber which faces onto the pump chamber.

In one embodiment, said force means can further comprise a pump element arranged for displacing intermediate medium towards the side of said at least one displacement element which is opposite to the side on which the pump chamber is located.

In one embodiment, the force means can be controlled partly based on the pressure present in the outlet and possibly also in the inlet of the pipe system.

In one embodiment, the force means can be controlled partly based on the temperature present at said side of said at least one displacement element, where the force is applied.

In one embodiment, the force means can be controlled partly based on the pressure present at said side of said at least one displacement element, where the force is applied.

BRIEF DESCRIPTION OF THE DRAWINGS

Notwithstanding any other forms which may fall within the scope of the method and apparatus as set forth in the Summary, specific embodiments of the method and apparatus will now be described, by way of example, and with reference to the accompanying drawings in which.

DETAILED DESCRIPTION OF SPECIFIC EMBODIMENTS

Figure 1:
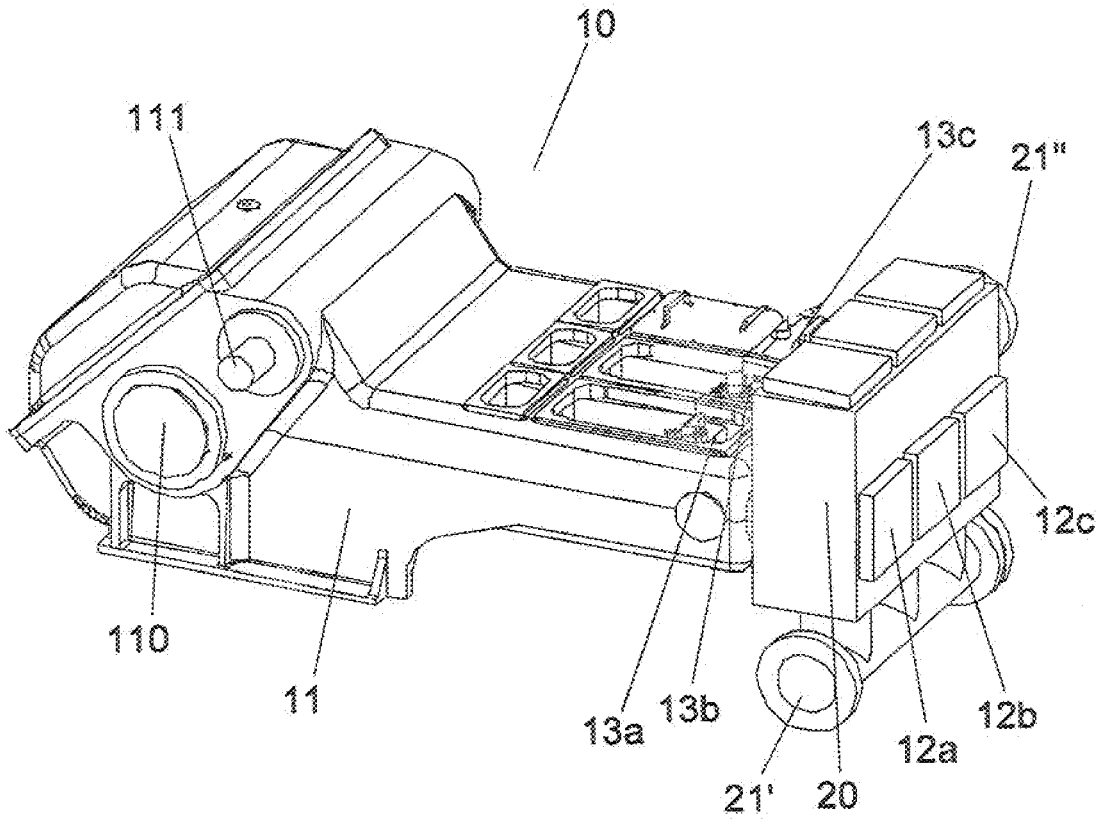
FIG. 1 is an exterior perspective view of a positive displacement pump according to the state of the art.

For a correct understanding of the invention, like parts will be indicated by the same numerals in the description of the figures below. FIG. 1 shows an embodiment of a positive displacement pump according to the state of the art. The pump 10 comprises three pump chambers 12*a*-*c*, which are integrated in a pump housing 12 connected to the crankcase 11.

The positive displacement pump 10 is configured as a triple displacement device in this case. In this embodiment, the pump chamber 12 comprises three pump sections configured as cylinder-piston combinations, the individual cylinders of which are indicated 13*a*-13*c*. Positioned within the cylinder chambers 13*a*-13*c* are three pistons 14*a*-14*c* (not shown), which function as displacement elements. As shown, each piston 14*a*-14*c* is connected to a piston rod 15*a*-15*c* (see FIGS. 3 and 4), which piston rod 15*a*-15*c* is connected to some type of driving means. In this embodiment the driving means is configured as a crankshaft mounted for rotation in the crankcase 11, which is driven by the drive shaft 111 via an internal gear transmission in this case.

By means of the rotatably driven crankshaft 110, the pistons 14*a*-14*c* are reciprocally moved (translated) in the cylinder chambers 13*a*-13*c* forming part of the pump chamber via the various piston rods 15*a*-15*c*.

Figure 2A:
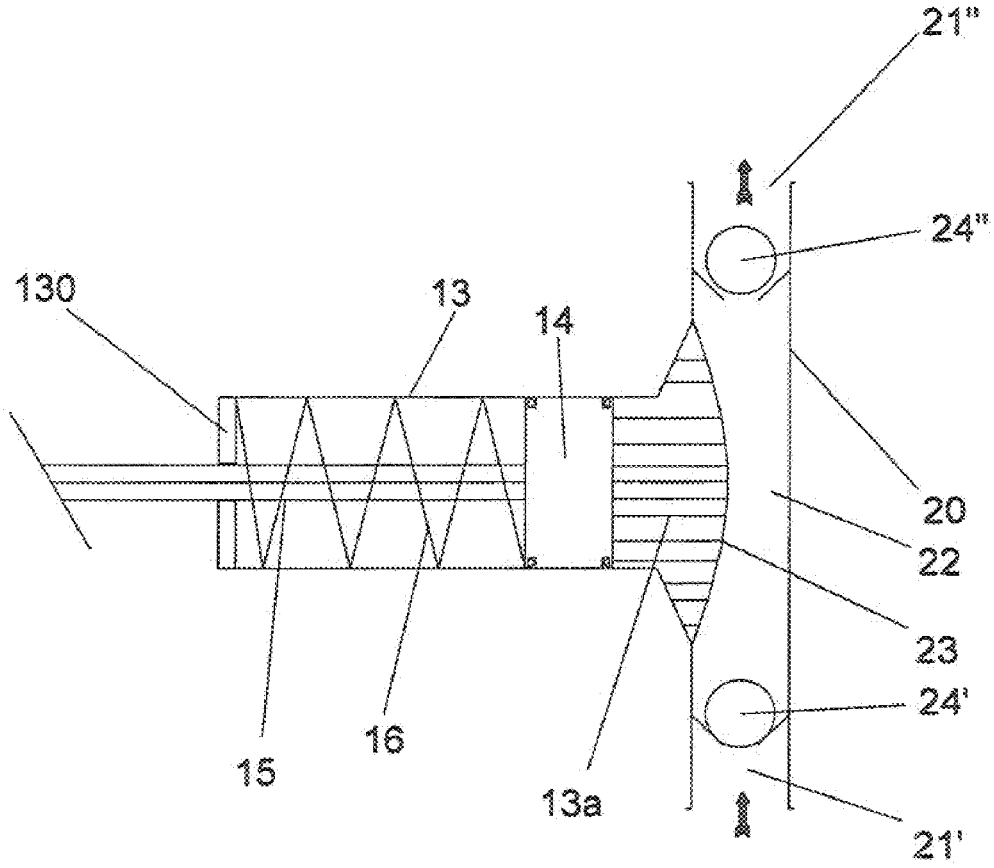
FIG. 2*a* shows a schematic diagram of a first, partial embodiment of a positive displacement pump in accordance with the invention.

Referring now to FIG. 2*a*, the pump housing 20 comprises a pump chamber 22. The pump housing 20 is incorporated in a pipe system having an inlet side 21' and an outlet side 21", which inlet side and outlet side are both shut off by means of one-way valves 24' and 24", respectively.

To displace a medium flowing through the pipe system, a displacement element in the form of a piston head 14 and piston rod 15 combination is provided, which can be translated into and out of the pump chamber 22 by driving means (not shown). As a result of the translating movement, the piston head and rod 14, 15 undergoes a suction stroke as well as a displacement stroke. During the suction stroke, the piston head 14 moves from the right to the left direction (from the point of view of FIG. 2*a*), thereby increasing the volume of the pump chamber space 22. Via the inlet side 21', a fluid or mixture to be pumped is introduced into the pump chamber space 22 past the one-way valve 24', which is open in that situation. The space becomes larger because the fluid in the intermediate fluid chamber 13*a* is moved from the right to the left, and the flexible separating element in the form of diaphragm 23 also is retracted to the left, toward the piston head 14.

During the displacement stroke, when the piston head and rod 14, 15 moves from the left to the right as is shown in FIG. 2*a*, the volume of the pump chamber space 22 is reduced and the fluid or mixture present in said pump chamber space is displaced via the outlet side 21". The one-way valve 24" opens, whilst the one-way valve 24' on the inlet side 21' remains closed. The fluid in the intermediate fluid chamber 13*a* is moved from the left to the right, and as shown in FIG. 2*a*, the diaphragm 23 also is pushed outwardly to the right and away from the piston head 14.

To level out the resulting forces which are exerted on the piston rod 15 and the drive means during the translating movement of the piston head 14 during the entire translating stroke, force means are provided by which the energy stored during the suction stroke is delivered during the next displacement stroke, thereby releasing at least some of the force required for the displacement stroke to occur. In the embodiment shown in FIG. 2*a* the force means is configured as a spring element 161, which may have been pre-loaded, and which is supported on the bottom 130 of the cylinder housing 13. The spring element 161 exerts a force on the piston head 14 that moves within the cylinder housing 13.

Figure 2B:
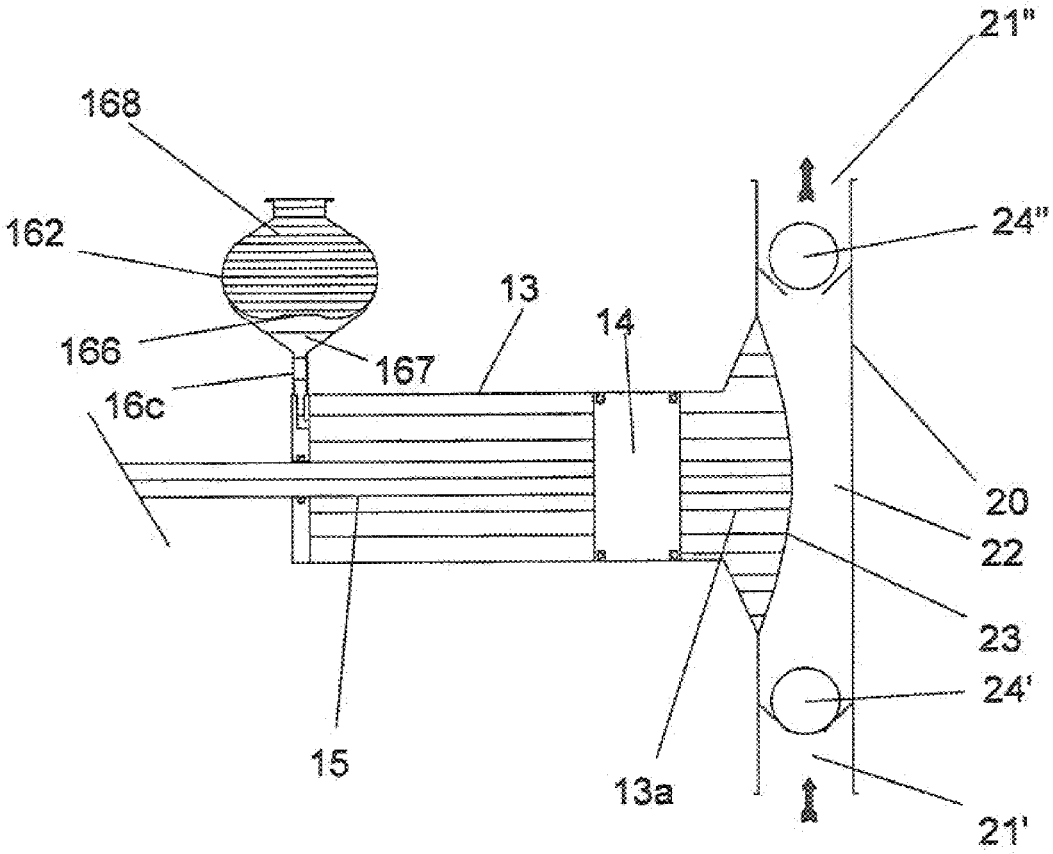
FIG. 2*b* shows a schematic diagram of a further, partial embodiment of a positive displacement pump in accordance with the invention.

FIG. 2*b* shows another embodiment of said force means 16 according to the invention, in which the force means comprise an accumulator 162, in which a separating element 166 is positioned, which separates the space of the accumulator 16 into a first space 168 and a second space 167. The first space 168 is filled with a gas which is separated from the working medium present in the second space 167 possibly by the flexible membrane 166. The gas present in the first space 168 may be compressed air under a specific pressure, for example, while the medium present in the second space may be a liquid, for example. The working medium exerts a force on the piston head 14 because the accumulator 162 is in communication with the space 13' of the cylinder 13 in which the piston head 14 is moved during use.

Figure 2C:
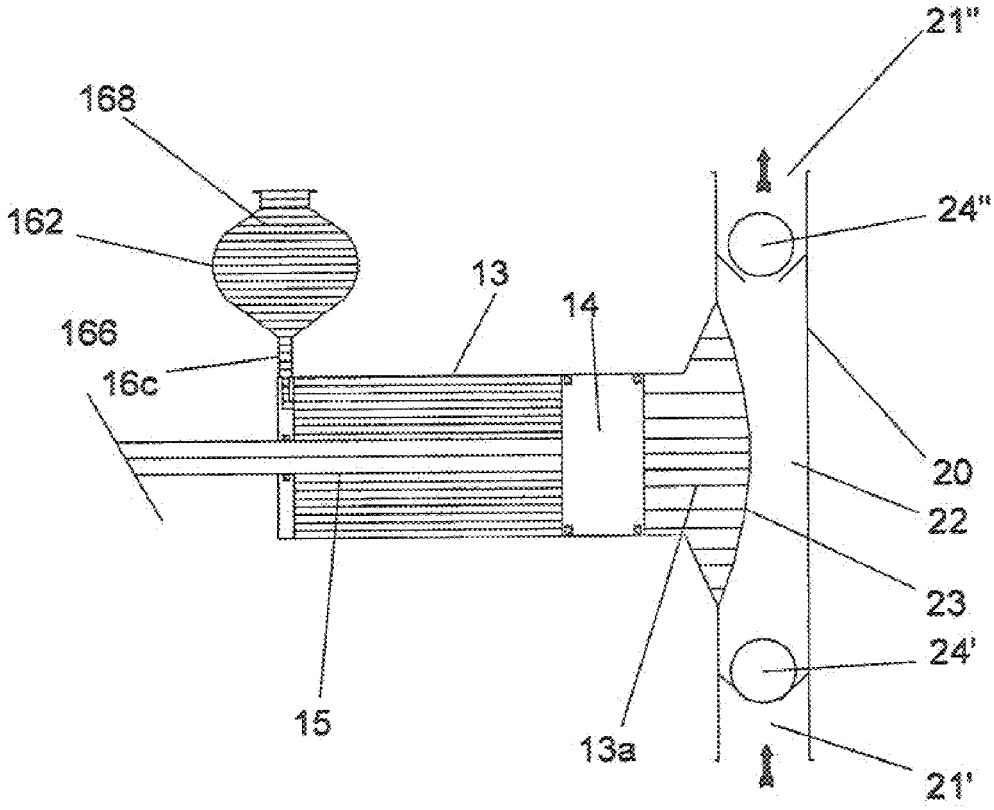
FIG. 2*c* shows a schematic diagram of a yet a further, partial embodiment of a positive displacement pump in accordance with the invention.

In the embodiment as shown in FIG. 2*c*, the force means also comprise an accumulator 16, which in this instance is completely filled with a gaseous working medium and wherein the separating element 166 as shown in FIG. 2*b* is absent.

Figure 3:
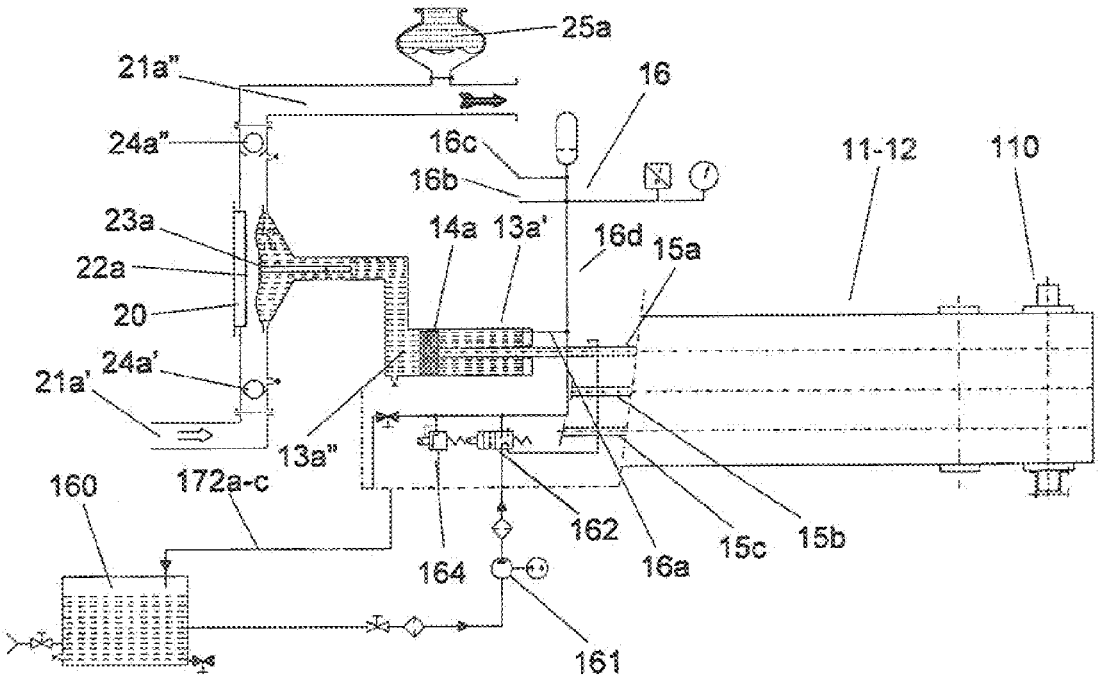
FIG. 3 shows a schematic diagram of a partial embodiment of a positive displacement pump according to the invention.
Figure 4:
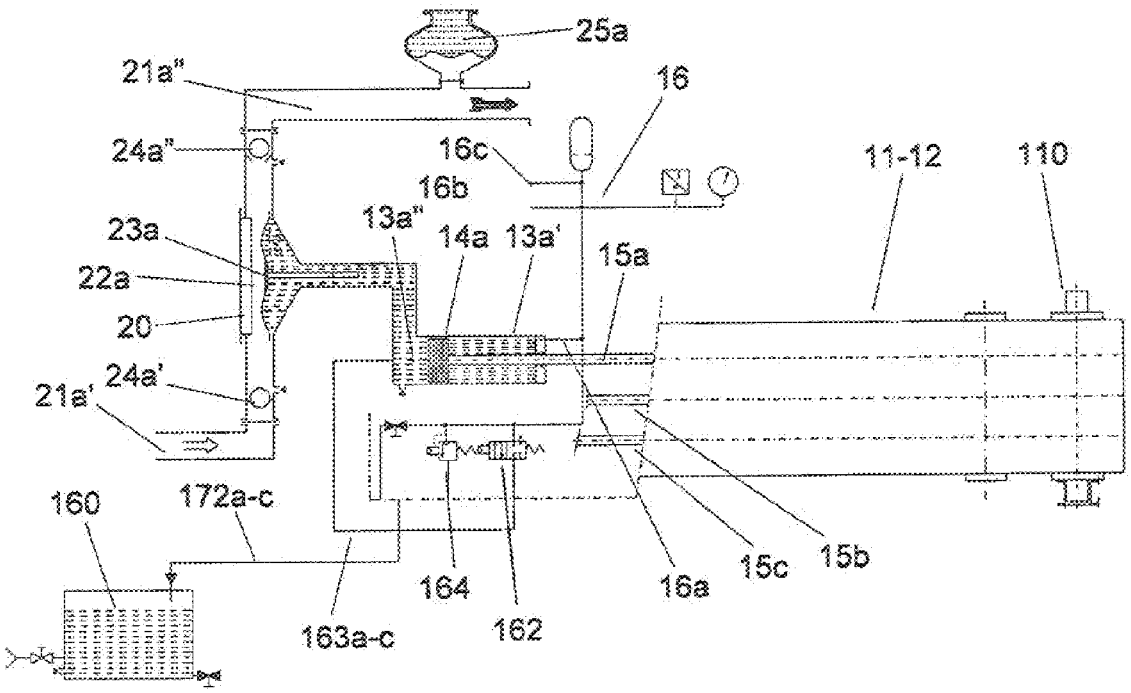
FIG. 4 shows a schematic diagram of a partial embodiment of a positive displacement pump according to the invention.

FIGS. 3, 4, 5*a* and 5*b* show a positive displacement pump, in this embodiment a triplex displacement device, although FIGS. 3 and 4 only show the detail of one of the three combinations of a displacement element in the form of a piston head 14 and piston rod 15, an intermediate chamber 13", pump chamber 22 and flexible separating element in the form of a diaphragm 23. An intermediate medium is present in the intermediate chamber 13". In some embodiments, the intermediate medium can be an incompressible fluid such as a liquid. In some embodiments the diaphragm is not a separate element but forms one wall (or portion of a wall) of the intermediate chamber which faces onto the pump chamber.

During the reciprocating movement in the cylinder chambers 13*a*'-13*c*', each of the piston heads 14*a*-14*c* displace the intermediate fluid, which is present in the intermediate chamber 13", in the direction of a flexible separating element in the form of a diaphragm or hose 23. The diaphragm or hose 23 isolates the displacement device 10 from the pump chamber 22, which is mounted in a pipe via connecting flanges 21*a*'-21*a*", through which aggressive or abrasive liquid flows, for example, may be pumped. The flexible separating element may also be a hose-like element.

During the displacement or delivery stroke, the movement of the displacement element is hydraulically transmitted to the diaphragm 23 via the intermediate fluid in the intermediate chamber 13", which diaphragm 23 likewise expands and pumps out the pumping fluid or slurry that is present in the pump chamber 22 via one of the two flange connections 21*a* and 21*b*, respectively. As is clearly shown in FIGS. 3 and 4, the pipe 21*a*'-21*a*" is fitted with one-way valves 24*a*' and 24*a*", which thus allows a displacement of the pumping fluid or slurry by means of the reciprocally movable flexible diaphragm 23*a* via the inlet side 21*a*' in the direction of the outlet side 21*a*". To absorb any pulsations in the slurry flow being pumped, a so-called pulsation damping device 25*a* is mounted in the downstream pipe portion 21*a*".

To reduce the load being exerted on the piston rod 15*a*-15*c* and the piston head 14*a*-14*c* while the positive displacement pump is being driven via the crankshaft 110, the crankshaft rod, the connecting rod and the crosshead (not shown), the displacement device is provided with force means that apply an additional force to the side of the respective piston head 14*a*-14*c* on the opposite side of the diaphragm 23.

Although in a first embodiment the force means may be in the form of a spring element 161 arranged round the piston rod 15 (see FIG. 2*a*), which is supported both on the piston head 14*a*-14*c* and the bottom 130 of the cylinder housing 13, in another form the force means can comprise a pressurisable working medium sourced from a storage tank 160 (see FIGS. 3 and 4). Said pressurisable medium can be a fluid which is supplied to the first cylinder chamber 13*a*'-13*b*'-13*c*' of the housing 13*a*-13*c* by means of pump 161, a valve 162 and supply lines 16*d* and 16*a*-16*c*, respectively.

Pressurisation of the force compensation system takes place once-only upon start-up of the displacement device, after which it is only used to replenish or compensate any leakage losses, to adjust the discharge pressure changes of the positive displacement device or to refresh fluid for temperature control purposes. Reference numeral 163*a* denotes a return line for accumulating any excessive intermediate working medium into the storage tank 160.

The pressurisation of the force compensation system may also take place from the displacement system itself, more in particular by means of the intermediate fluid, which is returned from the intermediate chamber 13*a*" via a feedback pipe 163*d*, to the valve 162 and the supply pipes 16*d* and 16*a*-16*c*, respectively. This embodiment is shown in FIG. 4.

In such arrangements an additional fluid force or pressure is exerted on the piston heads 14*a*-14*c* during the delivery stroke, as a result of which the load placed on the various parts as a result of the operational forces that occur during use are reduced, as already has been described in relation to the single displacement element embodiments. Thus, the essential, displacement force-delivering moving parts of the positive displacement pump 10 can be designed or used with smaller dimensions for the same operating conditions.

FIG. 4 shows an alternative diagram, in which in a further embodiment the intermediate chamber 13*a*"-13*c*" of each pump section is connected to the valve 162 via the pipe 163*d*. In this arrangement the fluid medium present in the intermediate chamber 13*a*"-13*c*" during the delivery stroke can be discharged under pressure and be used for being supplied to a first pressure chamber 13*a*'-13*b*' of another pump section. Similarly, the fluid medium present in the first cylinder chamber 13*a*'-13*c*' can be discharged under pressure to the first cylinder chamber 13*a*'-13*c*' of another pump section via the pipes 16*a*-16*c* and the common pipe 16*d* (or manifold) during the suction stroke, which other pipe section simultaneously carries out a displacement or delivery stroke.

In this way the various sections support one another upon alternately carrying out a delivery stroke and a suction stroke by reciprocally displacing the fluid medium under pressure. Thus, the forces necessary to be delivered by the driving means, crankshaft and gears on the various moving parts during the delivery strokes are significantly reduced, so that the various parts can be designed with smaller dimensions. This may result in a more compact drive means unit or crankshaft unit for the single-acting displacement device, which, in addition, can be cheaper to manufacture.

In some arrangements, the fluid that is used for effecting a reduction of the forces exerted on the pistons and the piston rods is the same as the intermediate medium that is used for moving the flexible diaphragm 23*a*-23*c* (23) during the delivery and suction strokes of the various sections.

Figure 5A:
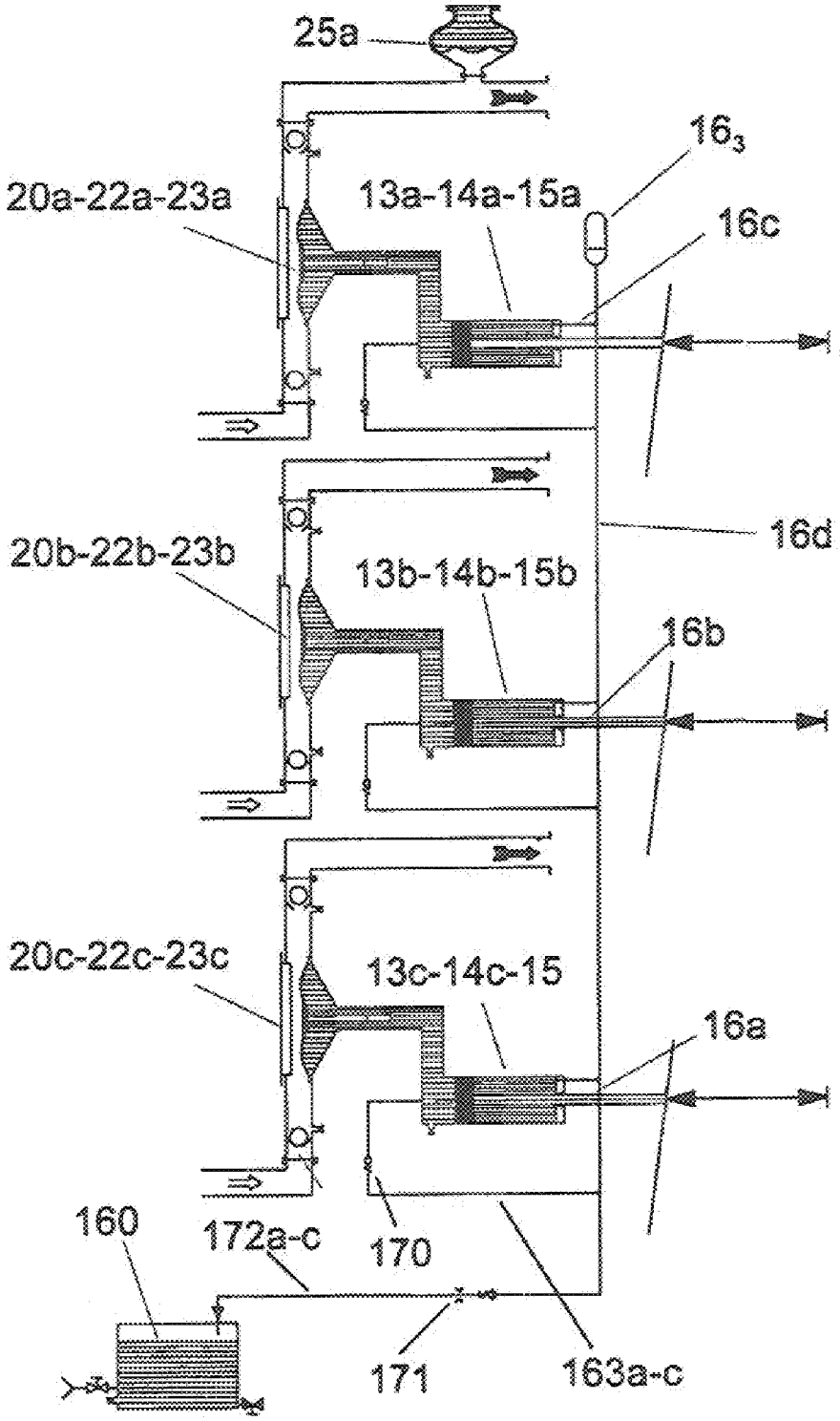
FIG. 5*a* shows a schematic diagram of a positive displacement pump according to the invention.
Figure 5B:
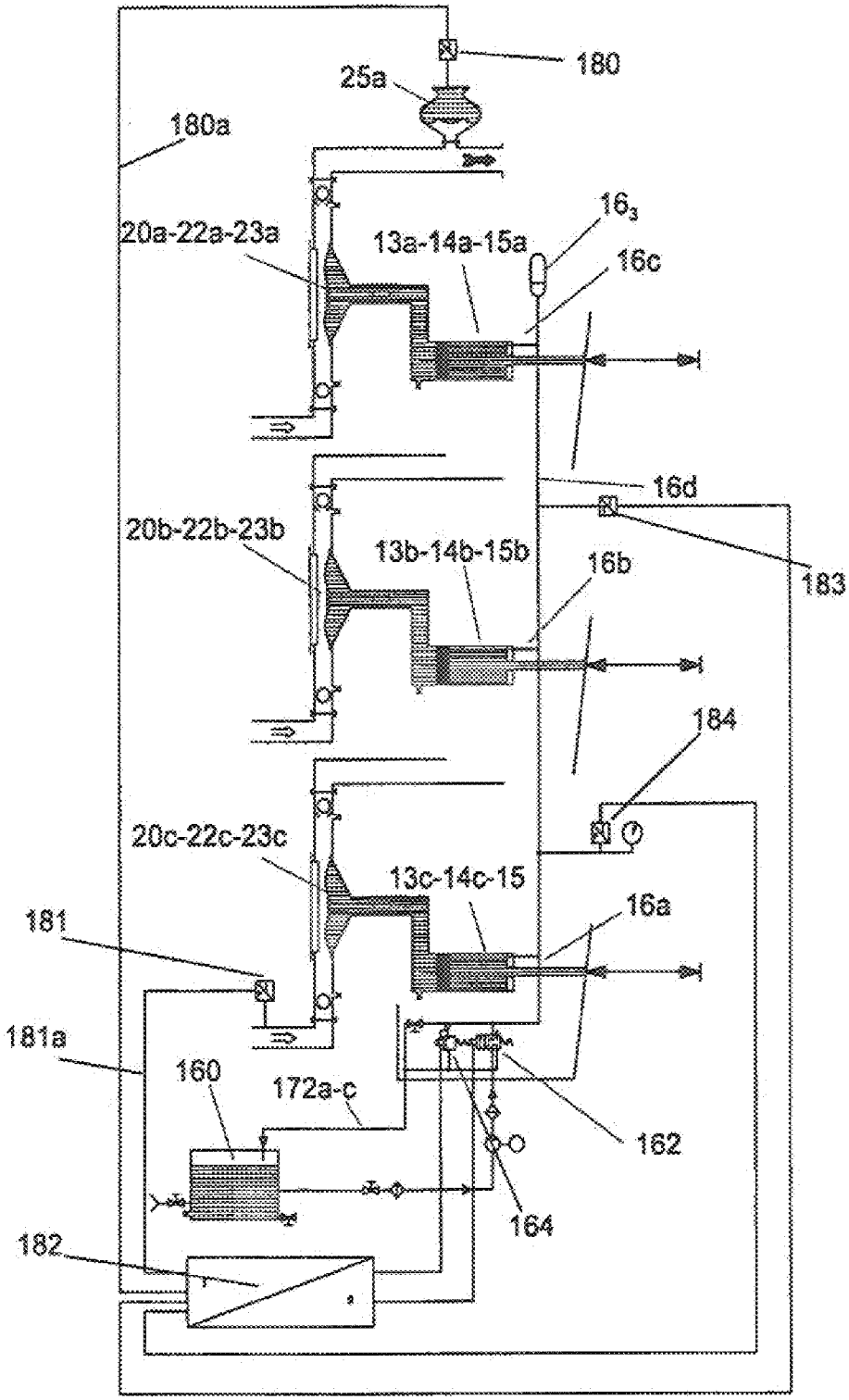
FIG. 5*b* shows a schematic diagram of a positive displacement pump according to the invention.
Figure 5C:
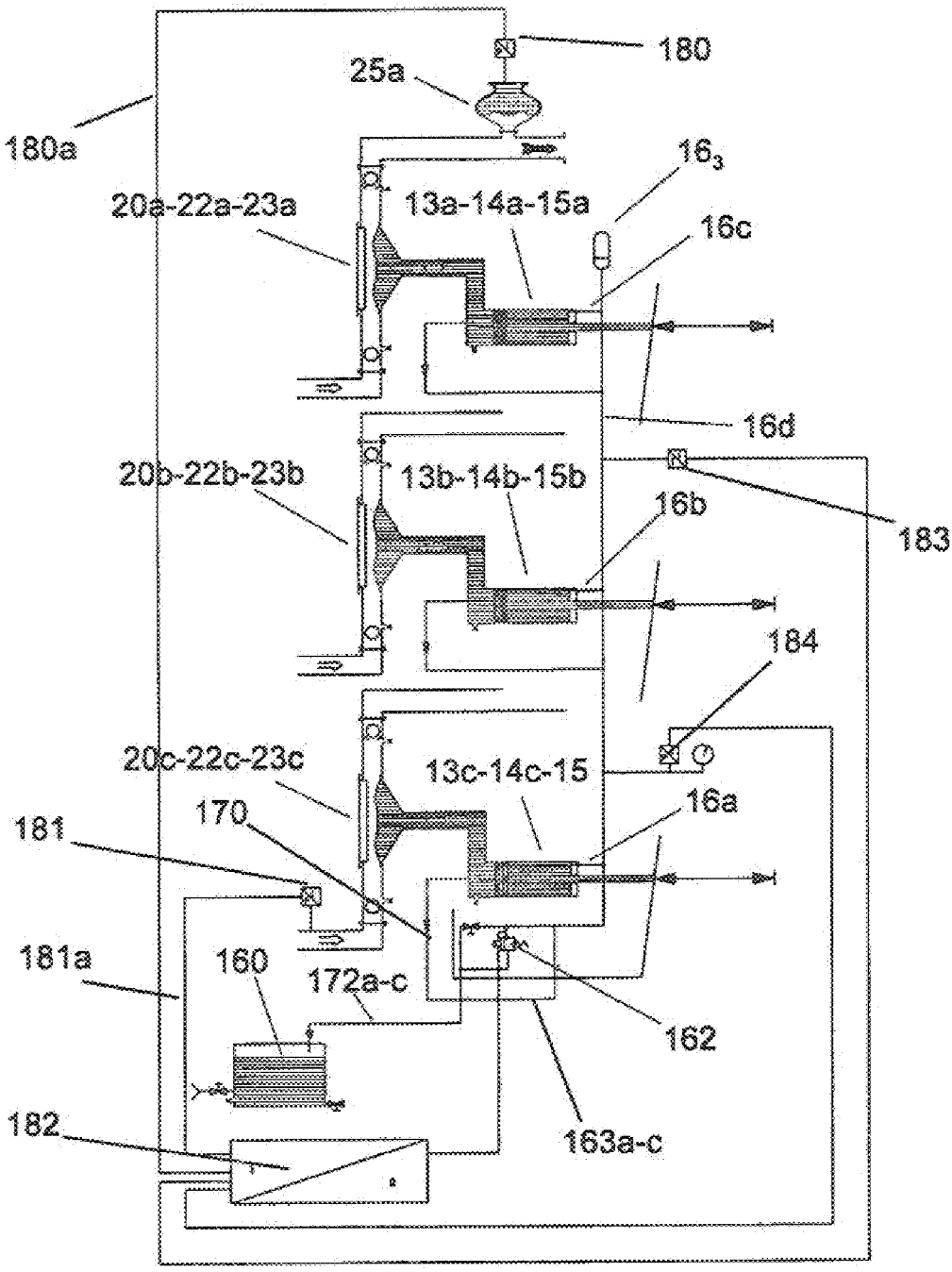
FIG. 5*c* shows a schematic diagram of a positive displacement pump according to the invention.

FIGS. 5*a*, 5*b* and 5*c* shows further elaborations of the embodiments shown in FIGS. 3 and 4, which are made up of three displacement sections, which are each controlled by a force means of some type. In the embodiments shown in FIGS. 5*a*-5*c*, use is made of an accumulator 163 as shown in FIG. 2*c*, which, unlike the single embodiment, only provides little elasticity in this case due to the volume increases and decreases of the chambers 13*a*'-13*c*', and these chambers 13*a*'-13*c*' otherwise compensate one another in volume during use. In the embodiments shown in FIGS. 5*a*-5*c*, some elasticity is needed to compensate for thermal effects, small mechanical (construction) differences (such as an incorrect phase control of the various displacement elements) and small leakage losses.

The embodiment of FIG. 5*a* discloses a passively operated construction of the force means according to the invention. A pressurisable working fluid medium is stored in the storage tank 160 which is connected with the supply line 16*d*. Supply line 16*d* is moreover connected with the chambers 13*a*"-13*c*" via a respective line 163*a*-*c*, in each of which a non-return valve 170 is located, allowing the displacement of intermediate chamber fluid during the suction and pressure strokes to the supply line 16*d* and hence towards the side of the piston head 14*a*-14*c* which is remote from the flexible diaphragm 23*a*-23*c*.

The non-return valve in the line 163*a*-*c* provide fluid pressure to the balancing manifold or supply line 16*d* during the discharge strokes of the individual cylinders. The orifice 171 in the drain line 172 to the tank 160 gives a continuous leakage from the manifold 16*d* towards the tank 160. This leakage is compensated again though the feed lines 163*a*-*c*. As the pressure in the manifold 16*d* drops due to the drainage flow towards tank 160 it falls under the discharge pressure present in the intermediate chambers 13*a*"-13*c*" during the discharge stroke of the piston. The pressure in line 16*d* is then automatically increased by tapping of fluid from the intermediate chamber 13*a*"-13*c*", which flows over the non-return valves 170 through lines 163*a*-*c*. The intermediate chamber is filled again by the 'normal' diaphragm position control system.

The said continuous leakage gives a continuous fluid refreshment in line 16*d* which provides cooling and automatic pressure control of the pressure in the manifold 16*d* such that this pressure is equal to the discharge pressure of the pump.

In FIGS. 5*b* and 5*c* two different techniques for actively operating a force means are shown. Reference numeral 180 denotes a pressure sensor positioned within the pulsation damping device 25*a* or in the outlet pipe 21*a*", whereas reference numeral 181 denotes a pressure sensor positioned in the inlet pipe 21*a*'. Both pressure sensors are connected to control device 182 via signal lines 180*a* and 181*a* respectively. Control device 182 controls a valve 162 in order to allow the passage of a working fluid for increasing the pressure. Control device 182 also controls valve 164 in order to discharge working fluid in order to decrease the pressure in the system.

Further signal inputs to the control device (in order to control the valves 162 and 164) are delivered from temperature sensor 183 and pressure sensor 184 positioned in the supply line 16*d*.

Using the input signals obtained with the pressure sensors 180-181 the control device 182 calculates the optimal working pressure in the supply line 16*d*, which calculated working pressure is set by operating the two valves 162 and 164. Moreover the temperature of the working fluid present in the supply line 16*d* can be controlled with the control device 182 by opening and closing the valves 162 and 164 based on the temperature measurement with the temperature sensor 183 and pressure sensor 184 thereby refreshing the working fluid of the force means In FIG. 5*b* a pump 161 is used to circulate the intermediate fluid from the storage tank 160 towards the supply line 16*d*, whereas excessive intermediate fluid can return towards tank 160 via return line 172*a*-*c*.

In FIG. 5*c* the pump element 161 is absent as here the intermediate medium is delivered via line 163*a*-*c* from the chambers 13*a*"-13*c*" towards supply line 16*d* during the pressure stroke of the displacement elements 14*a*-14*c*.

Please note that these features as shown in FIGS. 5*b* and 5*c* can also be used in the embodiments of FIGS. 3 and 4.

Referring to FIGS. 4 (and 5*c*) it is further noted that no pump element 161 (as shown in FIG. 3) is used for circulating the intermediate chamber fluid intended for the pressurisation of the force compensation system. In fact in the embodiment of FIG. 4, the intermediate chamber fluid can be discharged from line 163*d* during the pressure stroke of the positive displacement pump device. Therefore it is noted that in the embodiment of FIG. 4 the maximum pressure of the intermediate fluid in supply line 16*d* equals the maximum pressure occurring in the chambers 13*a*"-13*b*"-13*c*". In order to reduce the pressure in the supply line 16*d* in the event of a decreasing working pressure, the control device 182 must be able to control valve 162 for discharging intermediate chamber fluid.

The embodiment of FIG. 4 has the advantage over the embodiment of FIG. 3 in that no additional pump unit is required for pressurizing supply line 16*d*.

However also the maximum pressure in supply line 16*d* is limited to the maximum pressure delivered by the positive displacement pump, which drawback is however obviated with the embodiment of FIG. 3. Here the use of a pump element 161 allows higher pressures to be generated in supply line 16*d*, in fact higher than the pressure occurring in chambers 13*a*"-13*c*". Higher pressures may allow smaller amounts of intermediate fluid to be displaced from and to the supply line 16*d*, further reducing the constructional dimensions of the pump construction. Also lesser heat may also be generated during operation of the pump. The pressure in supply line 16*d* can also be controlled more precisely using the pressure measurements with sensors 180 and 181.

By way of example, the inventor has taken some experimental measurements to illustrate the effect of the application of a force means to a side of the displacement element in a pump arrangement in which the pump chambers are contiguous or in fluid communication.

Figure 6A:
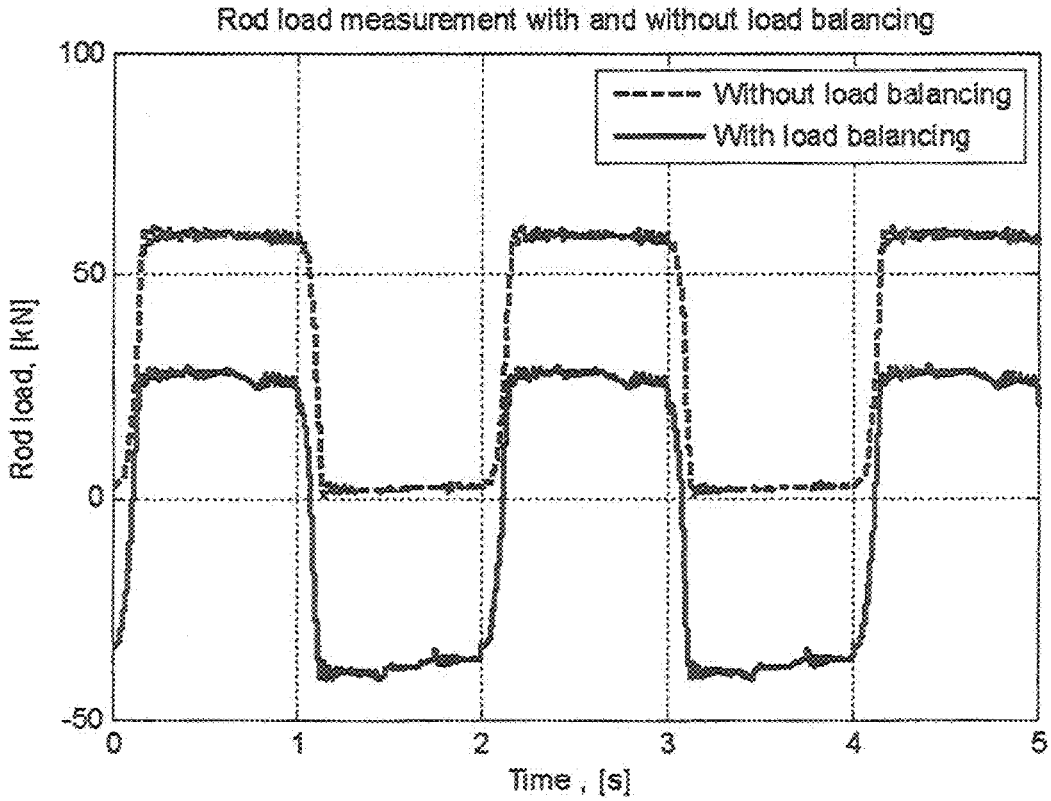
FIG. 6*a* shows a diagram of some experimental measurements of displacement element load measurements made using a positive displacement pump both with and without load balancing, where load balancing is carried out using apparatus which is in accordance with the invention.

FIG. 6A shows the inventor's measurement of piston rod (15) load (a force measured in kN) in a positive displacement pump with and without the usage of the force means according to the invention. The dotted line shows the measurements without the application of the force means, and the solid line with application of the force means. As can be seen in FIG. 6A, the rod load without application of the force means increases from a near zero level during the suction stroke to some maximum level during the discharge stoke. When the force means are applied (in this case a constant fluid pressure in the balancing manifold 16*d*) the maximum load during the discharge stroke is lowered, and the near zero load during the suction stroke is increased, but in opposite direction (negative sign). Consequently for this case the maximum absolute load is lowered. As a moving means has to be designed to take into account the maximum absolute value (disregarding the sign) of the piston rod load, the driving means can therefore be designed with smaller dimensions since this absolute maximum load to be carried is lower than in an arrangement without a force means according to the invention.

Figure 6B:
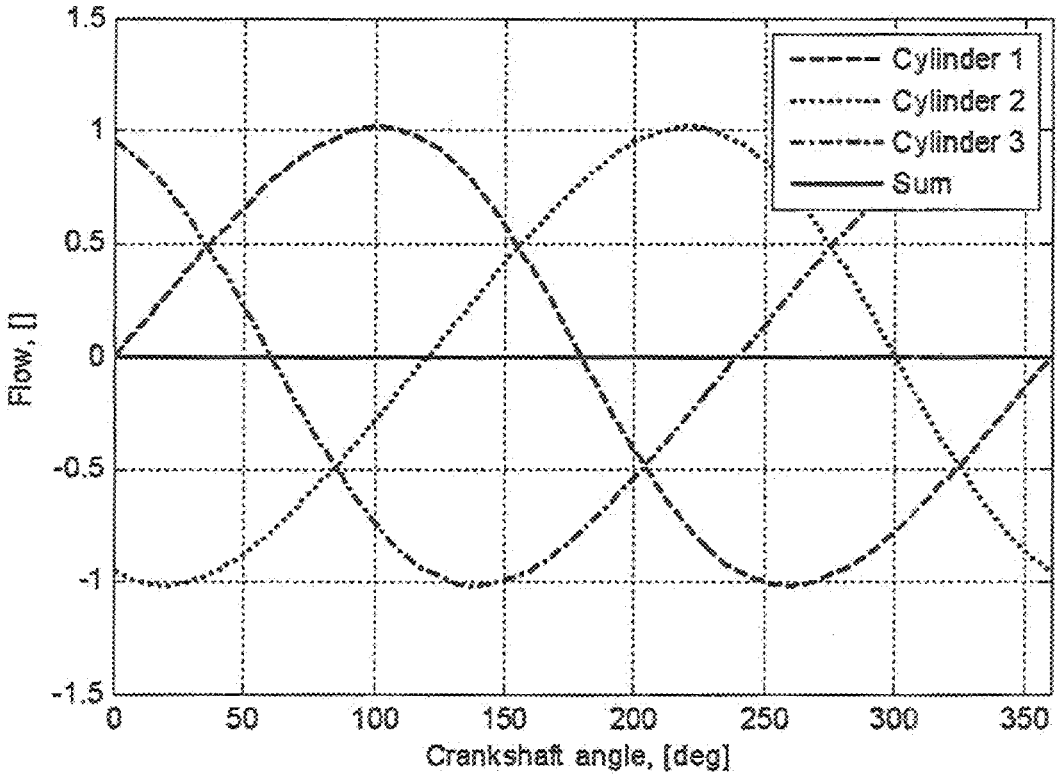
FIG. 6*b* shows a diagram of some theoretical calculations of individual fluid flow rates generated by individual displacement elements as a function of pump crankshaft angle made using a positive displacement pump having three displacement element, intermediate chamber, pump chamber and flexible separating element combinations and being apparatus which is in accordance with the invention.

FIG. 6B shown a theoretical calculation of the individual flows generated by the individual displacement elements opposite to the flexible separating elements as dotted lines, in the case of a three cylinder positive displacement pump using a crankshaft connecting rod mechanism as a driving means. The solid line shows the sum of the three individual flows, which is zero when a correct phase angle is used between the individual crank journals and thus pistons. The zero sum of these flows ensure that the volume in the balancing manifold 16*d* is constant during a pump cycle (one crankshaft rotation) hence limiting the size of the accumulator needed, which then only is required for compensating small volume differences due to incorrect phasing of the pistons, thermal expansion of the fluid and small leakages. The accumulator also makes the control system less sensitive when it has to react to minor discharge pressure changes and fluid refreshment for temperature control.

In a further alternative arrangement to the embodiments described, the selected force means need not be the same force means in each of the piston chambers, and for convenience a different force means may be used in one or more chambers. For example, one cylinder chamber may be fitted with a spring to whereas other chambers may be fluid filled. Some chambers may be interconnected by way of a common manifold or other type of housing without the need for every chamber to be so interconnected. In still further embodiments, the cylinder chambers also need not be of the same dimensional size.

In the foregoing detailed description of preferred embodiments, specific terminology has been used for the sake of clarity. However, the invention as described is not intended to be limited to the specific terms so selected, and it is to be understood that each specific term includes all technical equivalents which operate in a similar manner to accomplish a similar technical purpose. Terms such as "upper", "lower", "right", "left", and the like are used as words of convenience to provide reference points and are not to be construed as limiting terms.

In order to avoid repetition, and for ease of reference, similar components and features of alternative embodiments that are shown in different drawings have been designated with an additional character, such as the piston head 14, 14*a*, 14*b* and 14*c*.

While the invention has been described with reference to a number of preferred embodiments it should be appreciated that the invention can be embodied in many other forms.

In the claims which follow and in the preceding description, except where the context requires otherwise due to express language or necessary implication, the words "comprise" and variations such as "comprises" or "comprising" are used in an inclusive sense, i.e. to specify the presence of the stated features but not to preclude the presence or addition of further features in various embodiments of the apparatus.

The invention claimed is:

1. A positive displacement pump apparatus for displacing a pumping fluid, the apparatus comprising:

one or more pump chambers arranged in a pipe system for receiving the pumping fluid, the pipe system having at least one inlet which can be shut off by means of a valve, and at least one outlet which can be shut off by means of a valve;

wherein the one or more pump chambers are connected via at least one intermediate fluid chamber with at least one displacement element, the at least one displacement element being arranged to alternately carry out a suction stroke and a displacement stroke during its movement so as to displace intermediate fluid in the at least one intermediate fluid chamber, which thereby increases and reduces, respectively, the volume of the one or more pump chambers;

wherein at least one flexible separating element is provided at the one or more pump chambers to separate the intermediate fluid in the at least one intermediate fluid chamber from the pumping fluid, and wherein a force means is provided for applying force or energy to a side of said at least one displacement element at least during the displacement stroke, in such a manner that said force or energy counteracts the force exerted on the at least one displacement element by the intermediate fluid in the at least one intermediate fluid chamber, thereby reducing the overall force needed to carry out the at least one displacement stroke movement of the displacement element, wherein said force means uses a working fluid.

2. The positive displacement pump apparatus as claimed in claim 1, wherein the at least one displacement element is moved by a driving means arranged at one side of the one or more pump chambers.

3. The positive displacement pump apparatus as claimed in claim 1, wherein the force means receives force or energy which is generated during the suction stroke.

4. The positive displacement pump apparatus as claimed in claim 1, wherein the force means is located on a side of the at least one displacement element which is opposite to the side on which the one or more pump chambers is located.

5. The positive displacement device as claimed in claim 1, wherein the force means comprise a gas-biased accumulator for a working medium, which accumulator is in communication with the side of said at least one displacement element on the opposite side of the one or more pump chambers.

6. The positive displacement pump apparatus as claimed in claim 5, wherein the working medium is a pressurisable fluid.

7. The positive displacement pump apparatus as claimed claim 1, wherein the side of at least one of the at least one displacement element which is opposite to the side on which the one or more pump chambers is located is in communication with a side of at least one other of the at least one displacement element which is also located on the opposite side of another respective pump chamber, allowing the displacement of the intermediate fluid across the at least one displacement element.

8. The positive displacement pump apparatus as claimed in claim 7, wherein a number of displacement elements can be mutually translated in phase with one another in such a manner that the volume on the sides of the number of displacement elements which are in communication with one another is contiguous, and that the sum of the volumes remains substantially or entirely constant.

9. The positive displacement pump apparatus as claimed in claim 7, wherein the contiguous volume is defined within a manifold.

10. The positive displacement pump apparatus as claimed in claim 1, wherein at least one of the at least one displacement element is a plunger piston.

11. The positive displacement pump apparatus as claimed in claim 1, wherein at least one of the at least one flexible separating element forms one wall or a portion of a wall of the at least one intermediate fluid chamber which faces onto the one or more pump chambers.

12. The positive displacement pump apparatus as claimed in claim 1, wherein the working fluid comprises the intermediate medium, and wherein said force means further comprises a pump element arranged for displacing the intermediate medium towards the side of said at least one displacement element which is opposite to the side on which the one or more pump chambers is located.

13. The positive displacement pump apparatus as claimed in claim 1, wherein both sides of the one or more pump chambers adjacent to the at least one displacement element are in fluid communication with each other, allowing the displacement of the intermediate fluid from the side of the one or more pump chambers at the side of the at least one flexible separating element towards the other side of the one or more pump chambers.

14. The positive displacement pump apparatus as claimed in claim 1, wherein the force means is controlled partly based on the pressure present in at least one of the outlet and the inlet of the pipe system.

15. The positive displacement pump apparatus as claimed in claim 1, wherein the force means is controlled partly based on the temperature present at said side of said at least one displacement element, where the force is applied.

16. The positive displacement pump apparatus as claimed in claim 1, wherein the force means is controlled partly based on the pressure present at said side of said at least one displacement element, where the force is applied.

17. The positive displacement pump apparatus as claimed in claim 1, wherein temperature control is possible by exchanging fluid in a cylinder chamber on the opposite side of the at least one displacement element than where the one or more pump chambers is located.

18. The positive displacement pump apparatus as claimed in claim 6, wherein the working medium is a gas.

19. The positive displacement pump apparatus as claimed in claim 1, wherein the working fluid is provided by an independent force system.

* * * * *